US006415729B1

(12) United States Patent
Nedderman, Jr. et al.

(10) Patent No.: US 6,415,729 B1
(45) Date of Patent: Jul. 9, 2002

(54) SIDE PLATE RUDDER SYSTEM

(75) Inventors: William H. Nedderman, Jr., Middletown; James L. Dick, North Kingstown; Charles H. Beauchamp, Jamestown, all of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/740,756

(22) Filed: Dec. 14, 2000

(51) Int. Cl.[7] ..... B63H 25/06

(52) U.S. Cl. ..... 114/162; 114/144 R; 114/164; 440/40

(58) Field of Search ..... 440/40, 43, 42; 114/146, 162, 164, 144 R, 145 R, 170, 151

(56) References Cited

U.S. PATENT DOCUMENTS

| | | | | | |
|---|---|---|---|---|---|
| 340,237 | A | * | 4/1886 | Nagel et al. | 60/222 |
| 836,543 | A | * | 11/1906 | Taylor | 114/145 R |
| 2,483,675 | A | * | 10/1949 | Sheldon | 114/166 |
| 2,812,738 | A | * | 11/1957 | Munro | 440/68 |
| 3,182,623 | A | * | 5/1965 | Lehmann | 114/332 |
| 3,185,125 | A | * | 5/1965 | Haman | 440/27 |
| 3,585,957 | A | * | 6/1971 | Rich | 114/140 |
| 3,670,685 | A | * | 6/1972 | Milessa | 114/162 |
| 3,791,334 | A | * | 2/1974 | Wetzel | 114/35 |
| 3,818,959 | A | * | 6/1974 | Larsh | 114/126 |
| 3,924,557 | A | * | 12/1975 | Bloch | 440/75 |
| 3,982,493 | A | * | 9/1976 | Cronin | 114/144 R |
| 4,444,145 | A | * | 4/1984 | Kohl | 114/163 |
| 4,548,149 | A | * | 10/1985 | Del Roso | 114/162 |
| 4,556,005 | A | * | 12/1985 | Jackson | 114/146 |
| 5,186,420 | A | * | 2/1993 | Beauchamp et al. | 244/219 |
| 5,235,926 | A | * | 8/1993 | Jones | 114/126 |
| 5,813,357 | A | * | 9/1998 | Watson | 114/145 R |

FOREIGN PATENT DOCUMENTS

| | | | | |
|---|---|---|---|---|
| DE | 3619998 | * | 12/1987 | 114/162 |
| FR | 2436073 | * | 5/1980 | 114/162 |
| FR | 2520698 | * | 8/1983 | 114/162 |
| FR | 2692546 | * | 12/1993 | 114/162 |
| GB | 2030097 | * | 4/1980 | 114/162 |
| JP | 55-094894 | * | 7/1980 | 440/42 |
| SU | 874477 | * | 10/1981 | 114/162 |

* cited by examiner

*Primary Examiner*—S. Joseph Morano
*Assistant Examiner*—Ajay Vasudeva
(74) *Attorney, Agent, or Firm*—Michael J. McGowan; James M. Kasischke; Prithvi C. Lall

(57) ABSTRACT

The present invention relates to an improved steering system for a water craft and an improved method of steering. The steering system includes at least two variable camber plates or rudders mounted to a hull of the water craft for imparting a steering force to the water craft. Each of the variable camber plates is preferably formed from a flexible material and has a leading edge affixed to the hull. A linkage mechanism is attached to a steering device on the water craft and causes at least one of the plates to move relative to the hull and thereby vary the camber of the at least one plate.

18 Claims, 5 Drawing Sheets

SIDE PLATE RUDDER SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an improved system and method of steering marine vehicles, particularly personal water craft, that are propelled and maneuvered with water jets.

(2) Description of the Prior Art

In recent years, marine jet propulsion units have become popular for recreational water craft. Such units ordinarily have one or more propellers, which are driven within a tubular housing, for drawing water into the housing from one end and forcefully expelling the water at the other end to provide a driving force for the craft. In some units, the tubular housing itself is pivoted from one side to the other to provide steering. In other units, a deflector plate is provided at the exhaust end to deflect the jet flow to one side or the other of the craft.

A number of different steering systems have been used in connection with water craft. U.S. Pat. No. 3,982,493 to Cronin, for example, illustrates a skid control mechanism having longitudinally hinged flaps mounted to opposite sides of the boat bottom. The flaps are operable to deflect into an open, water-engaging position to prevent side slippage of the boat when making high speed turns. U.S. Pat. No. 4,004,536 to Bernier illustrates yet another anti-skid system in which an elongated vane extends along each side of the hull of the water craft.

U.S. Pat. No. 5,437,568 to Kobayashi illustrates a water jet propulsion system having an integrated rudder system.

U.S. Pat. Nos. 4,949,662 to Kobayashi and U.S. Pat. No. 6,086,437 to Murray illustrate steering systems for personal water craft. In the Kobayashi '662 patent, the steering system includes a rudder carried by a forward portion of the hull, which rudder is out of the water at high speeds and submerged at low speeds for assisting in low speeding steering. The Murray patent relates to lied a blow back rudder consisting of a rudder blade, a rudder shaft and a plate assembly that is pivotally mounted to a jet nozzle. The plate assembly pivots the rudder shaft and the rudder blade away from the exhaust port of the jet nozzle and out of the water stream in the non-deployed position. A spring is attached to the rudder assembly and the water craft for positioning the rudder blade in the water when the velocity of the water stream ceases or decays.

Another system for steering a jet powered water craft at low speeds is shown in U.S. Pat. No. 3,976,026 to Eastling. In this system, the jet power unit of a water craft is provided with a steering plate which is deflectable upwardly but which is continuously oriented in the direction of, but spaced below, the flow of water from the jet. The jet power unit includes movable steering deflectors at its exhaust port which steer the craft by deflecting the jet flow to one side or the other. The steering plate includes a linkage system for pivoting the plate relative to the craft in response to movement of the jet deflectors to maintain the plane of the steering plate parallel to the direction of jet flow.

Water craft safety remains a high priority in the transportation industry and in federal, state, and local governmental agencies. Of more recent concern is the safety of the increasingly popular, water-jet powered personal water craft. According to the U.S. Coast Guard, such water craft account for 36% of the vessels involved in marine accidents. Such water craft can travel at speeds as high as 60 mph and rapidly spin 360 degrees in the water. In addition, water-jet powered personal water craft offer almost no physical protection to the rider. Because of these facts, control of water-jet powered personal water craft is a critical factor. A recent study by the National Transportation Safety Board and the United States Coast Guard has indicated that the lack of off-throttle steering is a contributing factor in many personal water craft accidents. In many such craft, the only steering ability is that provided by steering the thruster jet nozzle. When an inexperienced driver wants to stop suddenly to avoid an unexpected obstacle their first panic reaction is to let go of the throttle. When the throttle is off the vehicle has no steerage and thus proceeds straight into the obstacle.

Mechanisms that steer the personal water craft at low throttle do not currently exist on commercial models. Thus, there is a need for a steering system which operates when the throttle is let off and requires no additional action from the driver other than turning the handle bars.

SUMMARY OF THE INVENTION

Accordingly, it is an object of the present invention to provide a steering system for a water-jet propelled water craft.

It is a further object of the present invention to provide a steering system as above which is effective at low throttle speeds.

It is yet another object of the present invention to provide a steering system as above which may be operated by a driver by turning a standard steering device onboard the water craft.

It is yet another object of the present invention to provide an improved method of steering water craft.

The foregoing objects are attained by the steering system and method of the present invention.

A steering system for a water craft in accordance with the present invention broadly comprises at least two variable camber plates or rudders mounted to a hull of the craft for steering the craft, particularly at low throttle. Each of the plates has a leading edge which is affixed to the hull and a trailing edge. The steering system further comprises a linkage mechanism attached to an onboard steering device, such as a wheel or handle bars, for causing the trailing edge of at least one of the plates to move relative to the hull and thereby vary the camber of the at least one plate and impart a steering force to the craft. In a preferred embodiment of the present invention, each of the plates or rudders is formed from a flexible material.

A method for steering a water vehicle is also disclosed. The method broadly comprises the steps of mounting first and second variable camber rudders to a hull of the water vehicle and varying the camber of at least one of the rudders using a steering device on the vehicle to impart a steering force to said vehicle.

Other details of the steering system and method of the present invention, as well as other objects and advantages attendant thereto, are set forth in the following detailed description and the accompanying drawings wherein like reference numerals depict like elements.

DESCRIPTION OF THE PREFERRED EMBODIMENT(S)

Figure 1:
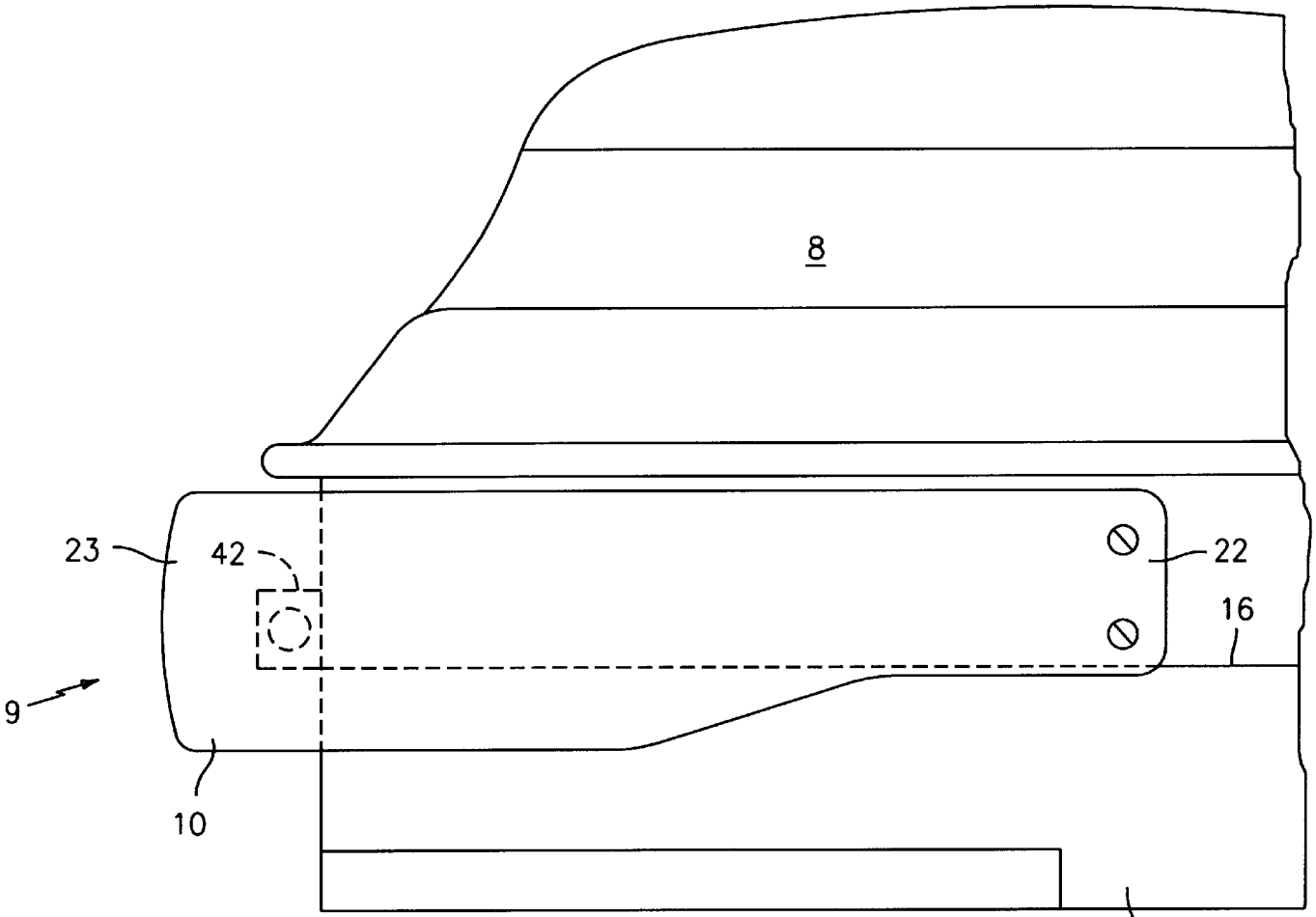
FIG. 1 is a side view of a personal water craft having a side plate rudder steering system in accordance with the present invention.

Referring now to the drawings, a personal water craft 8, such as a personal water-jet propelled craft, containing a first embodiment of a side plate rudder steering system 9 is illustrated in FIGS. 1–4. As shown therein, the system includes flexible, variable camber plates 10 and 12 aligned with and mounted to respective sides of the hull 14 of a water craft. Each of the plates 10 and 12 preferably extends downwardly below the chine 16 of the hull 14 as shown in FIG. 1. Alternatively, the bottom of each of the plates 10 and 12 may extend downwardly to the level of the chine 16 so that the plates 10 and 12 do not extend below the hull 14.

Each of the plates 10 and 12 is fastened at its leading edge 22 and 24, respectively, to a respective side 18 and 20 of the hull 14. The trailing edges 23 and 25, respectively, of each plate or rudder 10 and 12 are movable relative to the hull 14.

Each of the plates 10 and 12 is preferably made of a flexible material. The flexible material can be any corrosion resistant flexible material including one selected from the group consisting of a fiberglass material, a plastic material, a corrosion resistant material, and corrosion resistant composites. If desired, the flexibility of the material forming each of the plates 10 and 12 may be varied over the length of each plate or rudder to produce a hydrodynamically optimum camber shape.

The water craft typically uses any suitable water jet propulsion system known in the art. In this type of propulsion system the hull 14 has a water intake 26 along its bottom for introducing water into the water jet propulsion system. Additionally, the water jet propulsion system has a movable outlet nozzle 28 for steering the water craft. The movable outlet nozzle 28 may be moved from side to side using any standard steering mechanism 29, such as a steering wheel, a joy stick, or handle bars, linked to the outlet nozzle 28.

The steering system further includes a linkage mechanism 30 (FIG. 4) for causing one or the other of the plates 10 and 12 to move away from a side of the hull 14. The linkage mechanism 30 includes guide blocks 32 and 34 mounted to the rear 36 of the hull 14 and a pair of rods 38 and 40 pinned to the outlet nozzle 28 using any suitable pin connection known in the art. Each of the rods 38 and 40 extends through one of the guide blocks 32 and 34 and terminates in a respective push plate 42 and 44.

Each of the rods 38 and 40 is preferably made from a semi-flexible, corrosive resistant material such as a fiberglass material or plastic material. If desired, the rods 38 and 40 could be replaced by steering cables.

While it is preferred to have push plates 42 and 44 at the ends of the rods 38 and 40, these plates are not essential to operation of the system.

Figure 2:
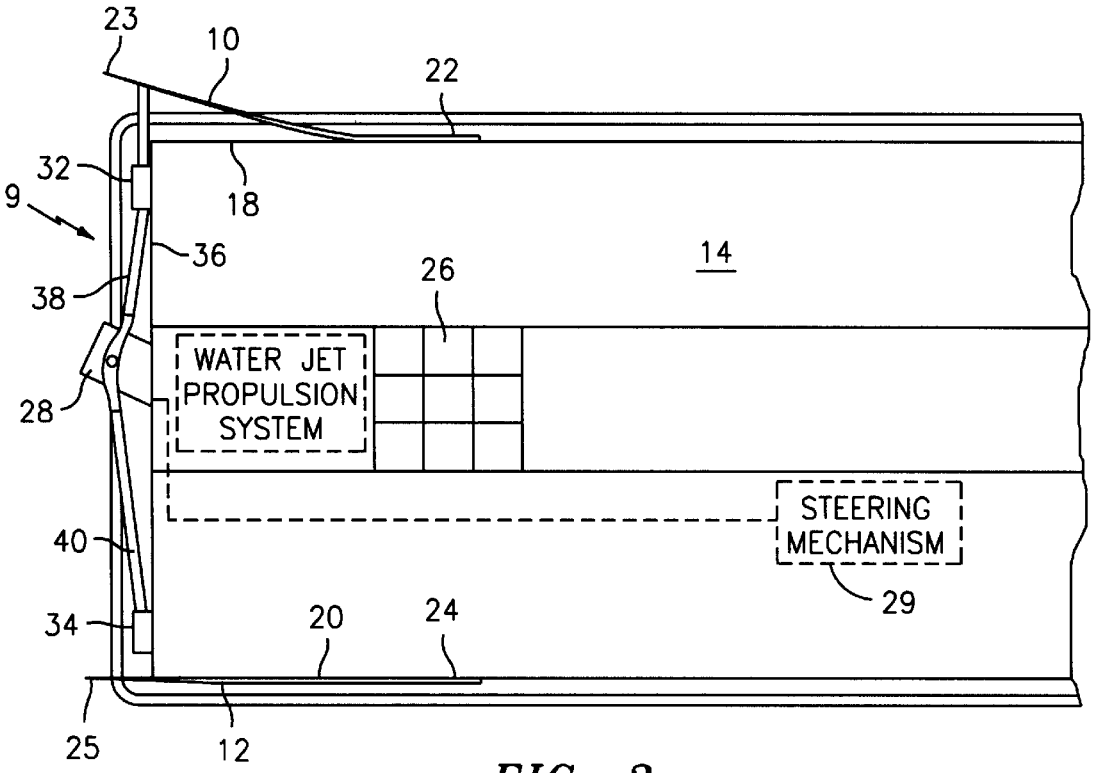
FIG. 2 is a bottom view of the water craft and steering system of FIG. 1.

In operation, when the jet nozzle 28 is steered to the starboard as shown in FIG. 2, the starboard rod 38 pushes on the flexible plate or rudder 10 to bend the plate or rudder 10 away from the side of the hull 14 and thus produce a cambered control surface interfering with hydrodynamic flow and steering the craft to the starboard. Meanwhile, the port rod 40 pulls away from the plate or rudder 12 which remains substantially straight and in position against the side of the hull 14. When turning to the port, the port rod 40 pushes against the plate or rudder 12 and moves it away from the side of the hull 14. At the same time, the starboard rod 38 pulls away from the plate or rudder 10 which remains substantially straight and in position against the side of the hull 14. As can be seen from the figures, the more one of the plates 10 and 12 is moved away from a side of the hull 14, the more the camber changes.

When the water craft 8 is traveling at high speed, the hull 14 will be planning and the plates 10 and 12 will be mostly out of the water. Thus, the turning force due to the plates 10 and 12 will be minimal, and most of the turning force will come from the water jet outlet nozzle 28 which is being operated by the steering mechanism 29. When the water craft 8 is slowing down, particularly in an off throttle situation, the water craft 8 will sink back into the water and more of the plates 10 and 12 will be in the water to produce a larger steering force. If the operator leans into the turn, this will put the flexed rudder 10 or 12 deeper into the water, producing a larger turning force.

The steering system 9 of the present invention provides improved steering capability with the throttle off and improves the steering performance of water craft, particularly personal jet-propelled water craft. The steering system 9 of the present invention has no negative impact on vehicle resistance and acceleration when going straight.

The steering system 9 described above uses semi-flexible rods 38 and 40 mounted on the stern of the water craft 8 to actuate the plates 10 and 12. This particular configuration is used to have minimal impact on the design of a personal water craft and to allow easy retrofits; however, there are a large number of different linkages that could be used to actuate the plates 10 and 12. Stiff rods could be used in lieu of the semi-flexible rods with a slide pin linkage on the jet nozzle 28. Rods with a pinned joint in the middle and multiple guide blocks could be used. If desired, the linkage mechanism 30 could be moved inside the vehicle hull 14. If desired, the rods 38 and 40 do not have to be linked directly to the jet nozzle 38, rather a separate pivot arm could be used.

Figure 5:
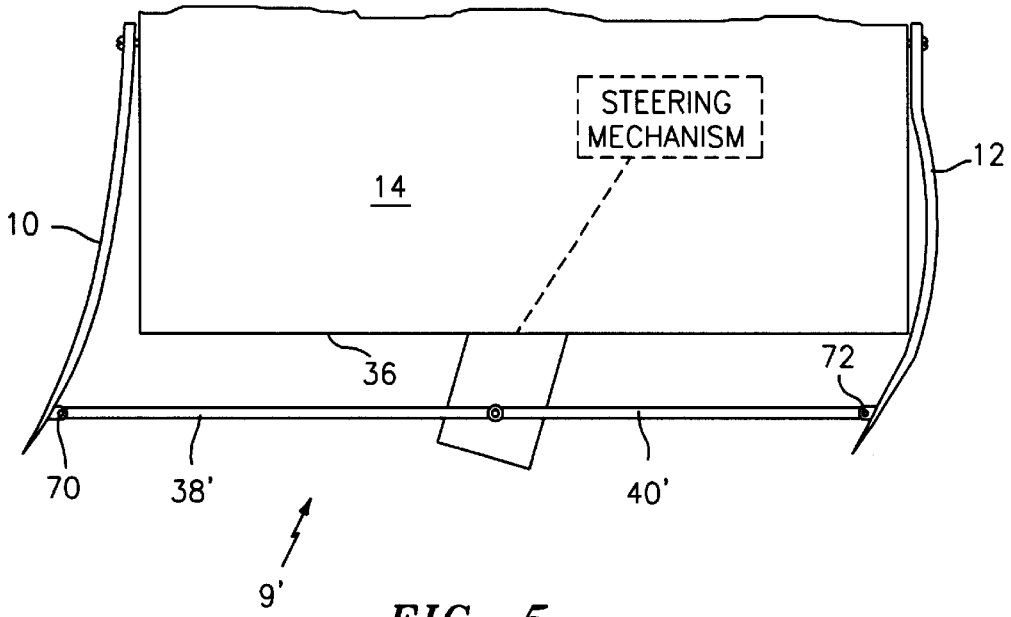
FIG. 5 is a bottom view of an alternative embodiment of a steering system for a water craft.
Figure 3:
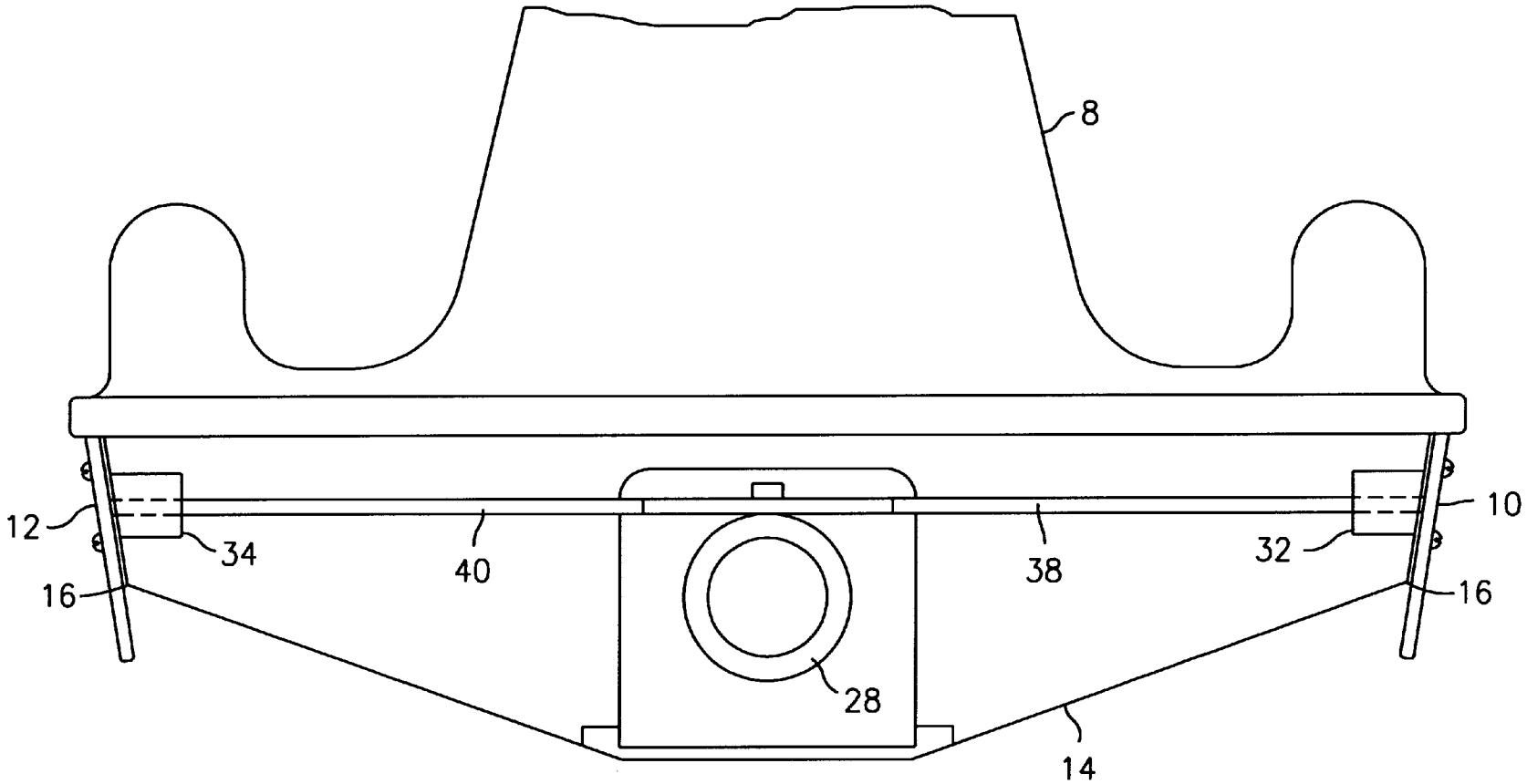
FIG. 3 is a rear view of the water craft and steering system of FIG. 1.
Figure 4:
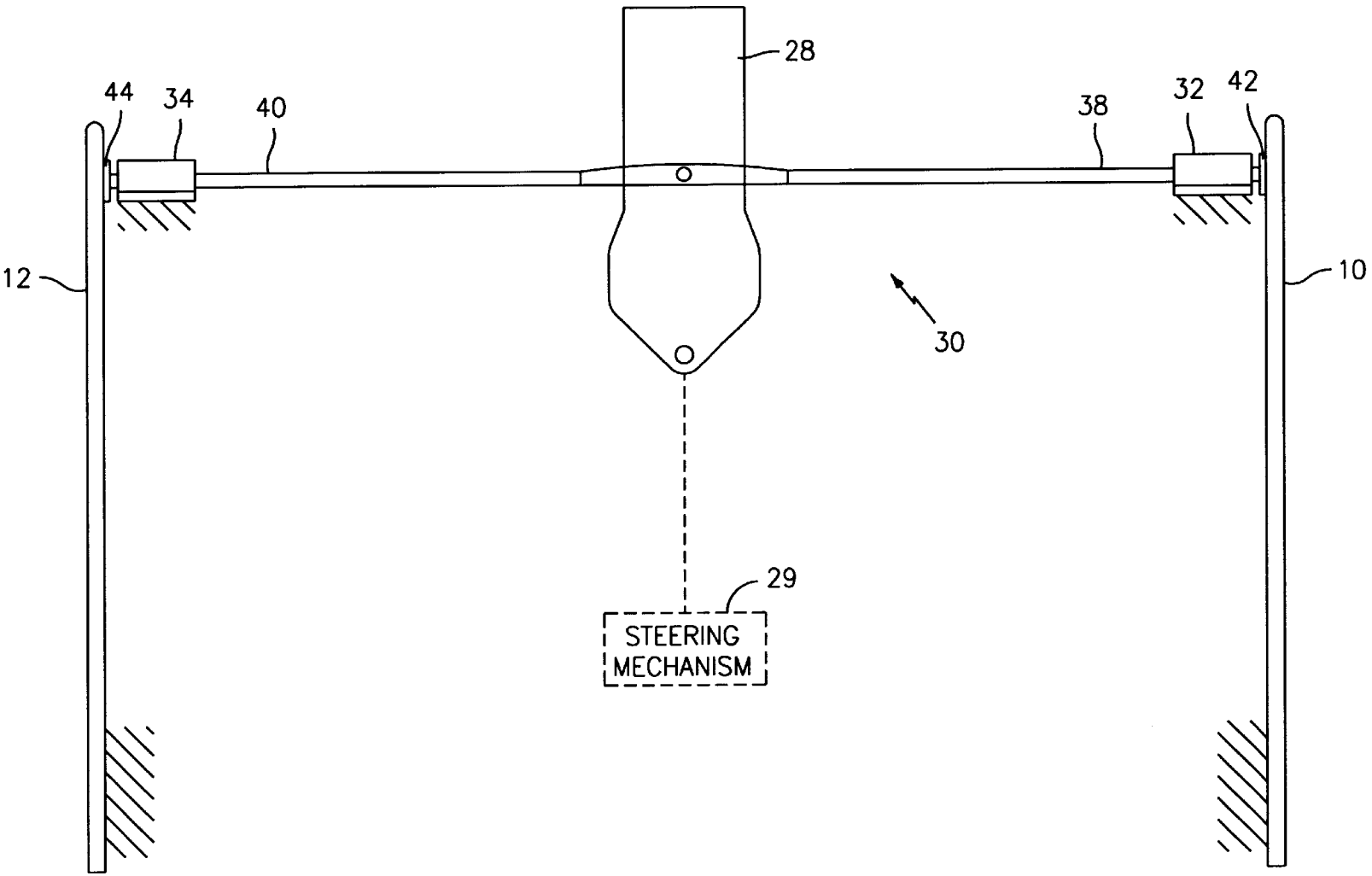
FIG. 4 schematically illustrates the linkage mechanism for the steering stem of FIG. 1.

FIG. 5 illustrates an alternative embodiment of a steering system 9' in accordance with the present invention. In this embodiment, the flexible plates 10 and 12 are mounted to the sides of the hull 14 of a water craft as in the previous embodiment. In this embodiment, however, the linkage mechanism 30 includes a pair of rods 38' and 40' which are each pinned to one of the plates 10 and 12 at points 70 and 72 respectively so that they pull on the plates 10 and 12 as well as push them. During a turn, both plates 10 and 12 are bent as shown in FIG. 5. An advantage to this type of steering system is an increase in the turning force relative to that obtained by bending only one of the plates 10 and 12.

Figure 6:
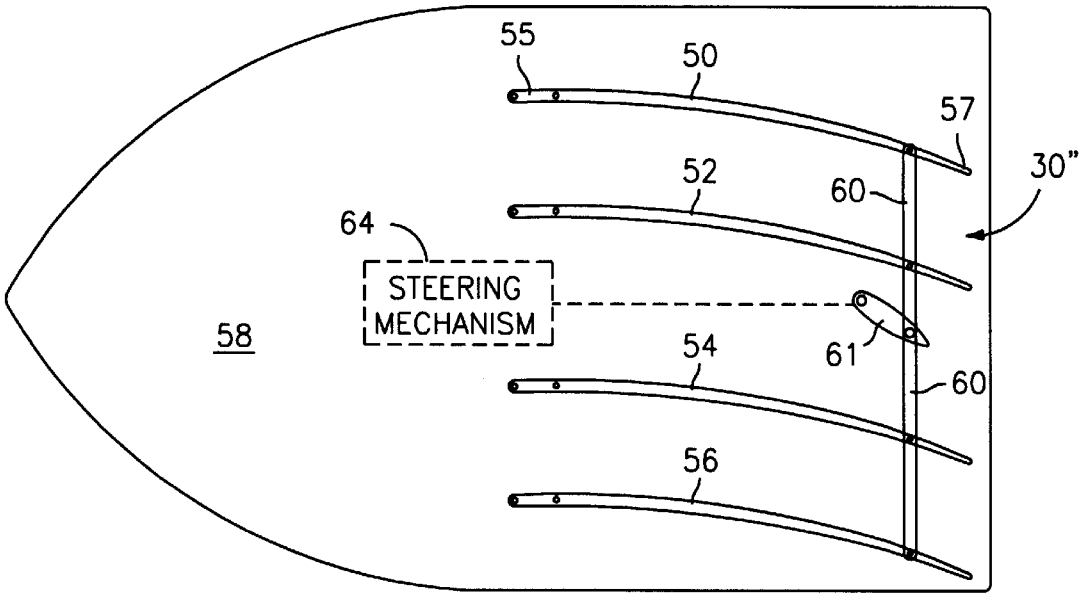
FIG. 6 is a bottom of view of yet another alternative embodiment of rudder steering system for a water craft.
Figure 7:
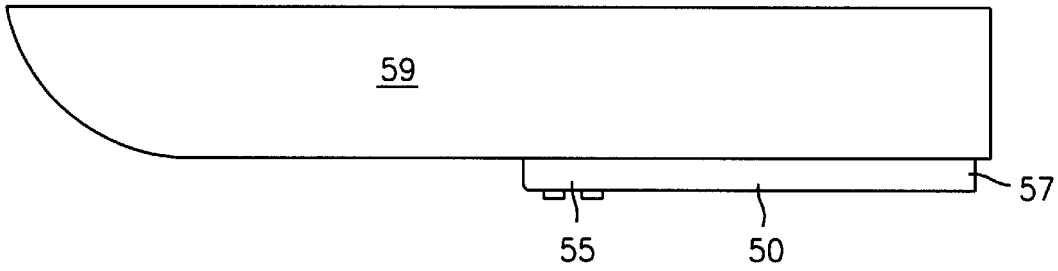
FIG. 7 is a side view of the side plate rudder steering system of FIG. 6.

FIGS. 6 and 7 illustrate another embodiment of a steering system in accordance with the present invention. In this system, a plurality of flexible plates 50, 52, 54 and 56 are mounted on the bottom 58 of the hull 14 of a water craft. The flexible plates 50, 52, 54, and 56 each have their leading edge 55 fixed in place on the bottom 58 of the hull 59, while their trailing edges 57 are free to move. The linkage mechanism 30" includes one or more actuating rods 60 pinned to each of the flexible plates 50, 52, 54 and 56 and to a member 61 which is movable about an axis 62 by an onboard steering mechanism 64. The actuating rod(s) both push and pull the flexible plates 50, 52, 54 and 56. This system has the advantage of increased rudder area for increasing the turning force. Additionally, in this system, the flexible plates 50, 52, 54, and 56 would always be in the water (except when jumping) and thus provide more reliable steering capability, particularly for a novice operator.

The invention may have other variations not specifically described in this specification. While it is preferred to form each of the variable camber plates 10 and 12 from a flexible material, they could each be formed by any suitable variable camber foil structure known in the art. While the steering system of the present invention is designed for personal jet-propelled water craft, it can be used on any water craft that is propelled and steered by a pivoting water-jet and thus cannot be steered unless it is under power. The steering system of the present invention could be used to provide steering for any water vehicle including a submerged vehicle such as a submarine, a remotely operated vehicle, and an autonomous underwater vehicle.

The steering system of the present invention enables the use of water-jet propulsion for marine vehicles where currently such an application would be impractical or unsafe.

It is apparent that there has been provided in accordance with the present invention a side plate rudder system which fully satisfies the foregoing advantages, means, and objects set forth hereinbefore. While the present invention has been described in the context of specific embodiments thereof, other alternatives, modifications, and variations will become apparent to those skilled in the art having read the foregoing description. Therefore, it is intended to embrace those alternatives, modifications, and variations as fall within the broad scope of the appended claims.

What is claimed is:

1. A steering system for a water craft having a hull and a steering device, said system comprising:

at least two plates capable of having variable camber adaptable to be mounted to said hull of said water craft for steering said water craft, each of said plates having a leading edge portion which is affixed to said hull and a trailing edge; and a linkage mechanism attached to said steering device and each said plate for causing said trailing edge of at least one of said plates to move relative to said hull and thereby vary the variable camber of said at least one plate so as to impart a steering force to said water craft.

2. The steering system according to claim 1 wherein each of said plates is formed from a corrosion resistant flexible material.

3. The steering system according to claim 2 wherein the flexibility of said plates varies over the horizontal length of the respective plate so as to produce a hydrodynamically optimum camber shape.

4. The steering system according to claim 1 wherein each of said plates is formed from a material selected from a group comprising a fiberglass material, a plastic material, a corrosion resistant metal, and a corrosion resistant composite material.

5. The steering system according to claim 1 wherein said leading edge portion of each said plate is adaptable to be attached to a respective side of said hull and extends downwardly below a chine of said hull.

6. The steering system according to claim 1 wherein said leading edge portion of each said plate is adaptable to be attached to a respective side of said hull and extends downwardly to the vertical level of a chine of said hull.

7. The steering system according to claim 1 wherein said steering device is a propulsor jet nozzle and each of said plates is joined and by said linkage mechanism to said propulsor jet nozzle.

8. A steering system according to claim 1 wherein:

said at least two plates have said leading edge adaptable to be mounted to a bottom surface of said hull; and said linkage mechanism comprises at least one actuating rod connected to said steering device on said water craft and to each said plate.

9. A steering system according to claim 8 wherein said at least one rod is pivotally connected to said steering device on said water craft and to each said plate for bending said plates in response to said steering device.

10. A steering system according to claim 8 further comprising more than two flexible plates adaptable to be mounted to the bottom of said hull.

11. A steering system for a water craft having a hull and a propulsor jet nozzle, said system comprising:

at least two plates capable of having variable camber mounted to said hull of said water craft for steering said water craft, each of said plates having a leading edge portion which is affixed to said hull and a trailing edge; and a linkage mechanism attached to said propulsor jet nozzle and each said plate for causing said trailing edge of at least one of said plates to move relative to said hull and thereby vary the variable camber of said at least one plate so as to impart a steering force to said water craft;

wherein said linkage mechanism comprises:

at least one guide block for each said plate, each guide block being adaptable to be mounted to the stern of said hull between said jet nozzle and an associated plate of said at least two plates; and at least one rod for each said associated plate, each rod being pivotally mounted to said jet nozzle, passing through at least one guide block, and contacting said associated plate for varying the camber of said associated plate.

12. The steering system of claim 11 wherein said at least two plates comprise a first plate and a second plate, said at least one rod pushing said first plate outward and an other rod pulling away from said second plate when said jet nozzle steers in a first direction, and said at least one rod pulling away from said first plate and said other rod pushing said second plate outward when said jet nozzle steers in a second direction.

13. The steering system according to claims 12 wherein each of said rods is formed from a flexible corrosive resistant material.

14. The steering system of claim 11 wherein:

said at least two plates comprise a first plate and a second plate; and said at least one rod for each plate comprising two rods, one rod and an other rod, said contacting between each rod and each plate being contacting by a pivotal connection whereby said at least one rod pushes said first plate outward and said other rod pulls said second plate inward when said jet nozzle is steered in a first direction, and said one rod pulls said first plate inward and said other rod pushes said second plate outward when said jet nozzle is steered in a second direction.

15. A steering system according to claim 14 wherein each of said plates is formed from a flexible material.

16. An off throttle steering system for a water craft having a hull and a steerable jet nozzle, comprising:

two flexible plates adaptable to be positioned on opposite sides of said hull for providing hydrodynamic steering to said water craft; and a linking means joining said steerable jet nozzle to said two flexible plates for moving at least one said plate in response to movement of said steerable jet nozzle.

17. The system of claim 16 wherein said linking means comprises:

at least two guide blocks adaptable to be mounted to said hull, each guide block located between said jet nozzle and one flexible plate, each guide block having a sliding aperture formed therethrough; and at least two rods, each rod being pivotally mounted to said steerable jet nozzle, passing through one said sliding aperture, and contacting one said flexible plate.

18. The system of claim 16 wherein said linkage means comprises at least one rod pivotally mounted to said steerable jet nozzle and pivotally mounted to said two plates for moving said plates in response to movement of said steerable jet nozzle.

* * * * *